United States Patent [19]

Mainprice

[11] 4,021,994

[45] May 10, 1977

[54] SCOOP DEVICE

[76] Inventor: Peggy L. Mainprice, 4210 NE. 85th St., Seattle, Wash. 98115

[22] Filed: Apr. 15, 1976

[21] Appl. No.: 677,378

[52] U.S. Cl. ..... 53/390; 229/62; 248/101; 294/19 R

[51] Int. Cl.[2] ..... B65B 67/12; B65B 67/04

[58] Field of Search ..... 53/390, 255, 261; 294/1 R, 19 R, 55, 57; 229/62; 248/94, 99, 101

[56] References Cited

UNITED STATES PATENTS

| | | | |
|---|---|---|---|
| 2,462,973 | 3/1949 | Kelrick | 248/101 |
| 2,521,029 | 9/1950 | Ward | 248/99 |
| 2,709,467 | 5/1955 | Hoeppner | 229/62 UX |
| 2,763,506 | 9/1956 | Denker et al. | 294/57 |
| 3,358,906 | 12/1967 | Faiers | 229/62 |
| 3,659,891 | 5/1972 | Pettenon et al. | 294/19 R |
| 3,677,596 | 7/1972 | Yonaites et al. | 294/19 R |
| 3,688,483 | 9/1972 | Hamilton | 294/19 R X |
| 3,754,785 | 8/1973 | Anderson | 294/19 R |
| 3,757,737 | 9/1973 | Drum et al. | 294/55 X |
| 3,870,261 | 3/1975 | McSwain | 248/101 |

*Primary Examiner*—Othell M. Simpson
*Assistant Examiner*—Horace M. Culver

[57] ABSTRACT

This device for removing animal droppings, consists primarily of a folding handle, to which is secured an open rim, which will support the open edge portion of a disposable bag, which is held in place by means of a hinged bag clamp, and the bag has a lip portion which extends outwards and away from the bag clamp.

2 Claims, 7 Drawing Figures

SCOOP DEVICE

This invention relates to shovel like devices, and more particularly to a scoop device.

It is therefore the principal object of this invention to provide a scoop device which will be particularly adaptable for use in removing dog feces from lawns, sidewalks, parking strips, etc.

Another object of this invention is to provide a scoop device which will employ the use of a specially designed and disposable plastic bag.

A further object of this invention is to provide a scoop device which will have clamp means for rendering the plastic bag secure to the bag rim of the device, and the handle of the device will be foldable.

Other objects of the invention are to provide a scoop device which is simple in design, inexpensive to manufacture, rugged in construction, easy to use and efficient in operation.

These and other objects will be readily evident upon a study of the following specification and the accompanying drawings, wherein.

Figure 1:
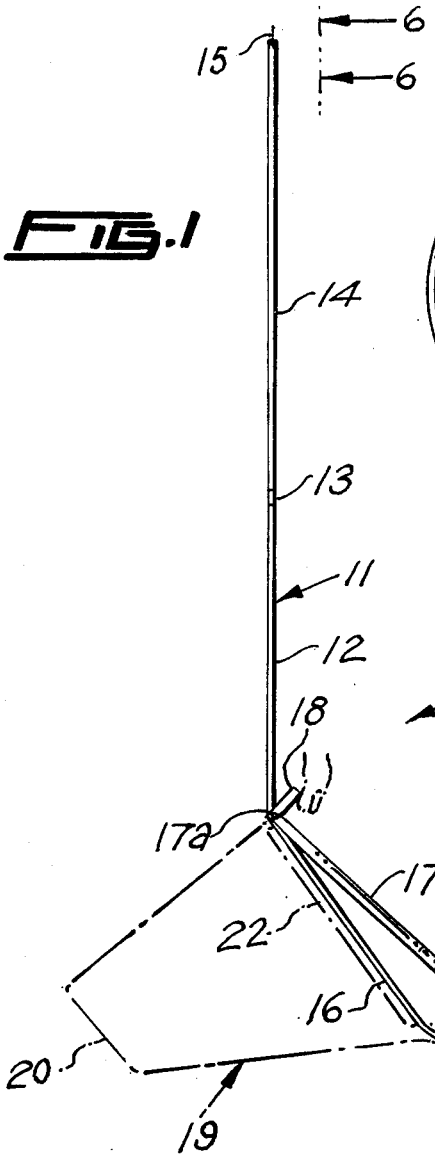
FIG. 1 is a side elevational view of a scoop device comprising the present invention, and shows a disposable bag in phantom lines, the bag clamp being shown disengaged from the bag rim of the device.
Figure 2:
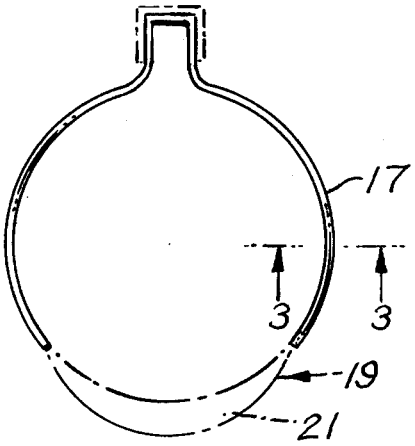
FIG. 2 is an enlarged, fragmentary plan view of the clamp portion of the device, showing the bag lip in phantom lines.
Figure 3:
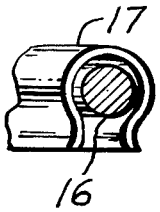
FIG. 3 is an enlarged, perspective view shown partly in section taken along the line 3—3 of FIG. 2, and shows the bag removed therefrom.
Figure 4:
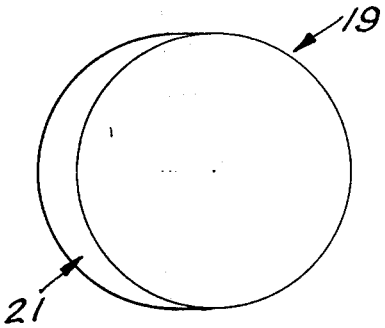
FIG. 4 is a diagrammatic, top plan view of the disposable bag of the device.
Figure 5:
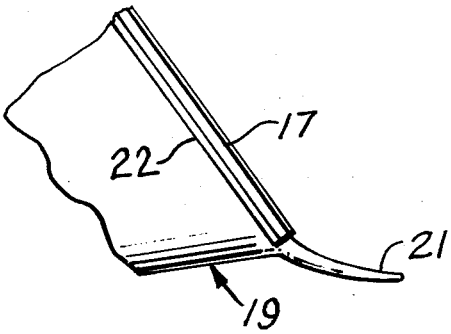
FIG. 5 is an enlarged, fragmentary side elevational view of the bag of the device, shown secured by the clamp.
Figure 6:
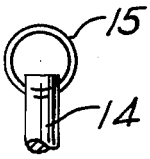
FIG. 6 is an enlarged side elevational view taken along the line 6—6 of FIG. 1

According to this invention, a scoop device 10 is shown to include a folding handle 11, made of metal or plastic material. Handle 11 includes a lower member 12, having a locking hinge 13 secured to one end, and the upper member 14 is secured to the other side of hinge 13. A ring 15 terminates the opposite end of member 14, so as to provide a means for hanging device 10, if desired. A bag rim 16 is secured to the lower extremity of member 12 of handle 11, and is provided with a curved end **16*a*, for a purpose which hereinafter will be described. A bag clamp 17 is hinged to the lower extremity of member 12, by means of hinge 17*a* and the lip 18, which is optional, is secured to bag clamp 17, so as to provide thumb means to pivot clamp 17. A disposable bag 19, of plastic or other suitable material, is tapered on the bottom end 20, or is provided with a double lip 21, so as to slip over and under the curved end 16*a* of the rim 16. The edge 22 of bag 19 is folded over rim 16, and clamp 17 is urged downwards thereon, so as to render bag 19 secure to rim 16**.

Figure 7:
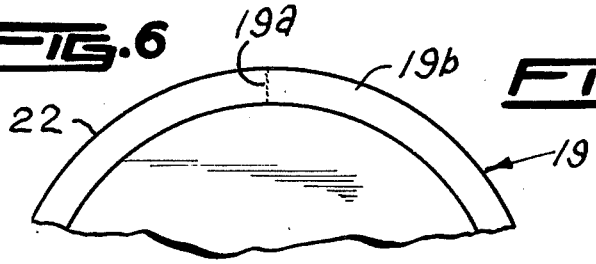
FIG. 7 is a fragmentary, top plan view of the bag, showing a perforated split seam and an adhesive strip for closing the bag, so as to prevent the odor of the feces from escaping from the bag.

As will be seen more clearly in FIG. 7 of the drawing, bag 19, at its upper end, is provided with a perforated, split seam **19*a*, so as to properly fit rim 16, and the edge 22 is provided with adhesive strip 19*b*, for closing bag 19**, after it is filled.

It shall be noted that the double lip 21 extends from the peripheral edge 22 of bag 19, and the device 10 and also bag 19 may be made in various sizes, and the lock hinge 13 is standard in the art, and enables handle 11 to fold easily for storage.

What I claim is:

1. A scoop device, comprising in combination, a tool and a detachable bag mounted on said tool, said tool comprising an elongated handle, a circular rim secured to said handle, said detachable bag being removably received upon said rim, a pivotable bag clamp attached to said handle, and means secured to said clamp for pivoting said clamp away from said rim by thumb pressure, said handle being comprised of an upper and a lower member which are pivotally attached together at their one ends by a locking hinge, said handle lower member being secured fixedly to said bag receiving rim, said bag receiving rim being angularly disposed to said handle lower member and being arcuately curved forwardly at its outer extremity, said rim removably receiving an edge of the periphery of an opening of said bag, and simultaneously receiving an extending lip portion of said bag, said lip portion of said bag extending from beneath the said curved extremity, said edge of said opening of said bag extending externally when said bag is placed upon said rim, said clamp being pivotally secured by a hinge at a lower end of said handle lower member, said clamp springingly engaging said bag edge between its inner periphery, said clamp frictionally urging against the outer periphery of said rim receiving said bag, said clamp comprising an open ring aligned with said rim when pivoted thereagainst so as to hold said bag, said open ring of said clamp at said hinge having a lip extending forwardly at approximately right angle to a plane of said clamp for manual pivoting by a person's thumb.

2. The combination according to claim 1, wherein said edge of said bag is provided with a perforated, split seam at the end of the opening opposite of said lip portion of said bag, and an adhesive strip is secured fixedly to said edge of said opening of said bag, so as to provide a means of closing said bag when it is full.

* * * * *